United States Patent [19]

Abe

[11] Patent Number: 4,829,440

[45] Date of Patent: May 9, 1989

[54] LEARNING CONTROL SYSTEM FOR CONTROLLING AN AUTOMOTIVE ENGINE

[75] Inventor: Kunihiro Abe, Higashimurayama, Japan

[73] Assignee: Fuji Jukogyo Kabushiki Kaisha, Tokyo, Japan

[21] Appl. No.: 753,844

[22] Filed: Jul. 11, 1985

[30] Foreign Application Priority Data

Jul. 13, 1984 [JP] Japan ..... 59-146650

[51] Int. Cl.[4] ..... F02M 51/00; F02M 41/26

[52] U.S. Cl. ..... 364/431.06; 123/486; 123/489; 364/431.12

[58] Field of Search ..... 123/440, 480, 486, 489; 364/431.05, 431.06

[56] References Cited

U.S. PATENT DOCUMENTS

| | | | |
|---|---|---|---|
| 4,309,971 | 1/1982 | Chiesa et al. | 123/480 |
| 4,348,727 | 9/1982 | Kobayashi et al. | 364/431.06 |
| 4,348,728 | 9/1982 | Sagisaka et al. | 364/431.06 |
| 4,365,299 | 12/1982 | Kondo et al. | 364/431.06 |
| 4,373,187 | 2/1983 | Ishii et al. | 364/431.06 |
| 4,430,976 | 2/1984 | Kondo et al. | 123/440 |
| 4,432,331 | 2/1984 | Yasuhara | 364/431.06 |
| 4,546,747 | 10/1985 | Kobayashi et al. | 123/440 |
| 4,566,068 | 1/1986 | Iwasaki et al. | 123/486 |
| 4,571,683 | 2/1986 | Kobayashi et al. | 364/431.05 |
| 4,594,667 | 6/1986 | Yasuhara | 364/431.06 |

*Primary Examiner*—Felix D. Gruber
*Attorney, Agent, or Firm*—Martin A. Farber

[57] ABSTRACT

Steady state of engine operating conditions is determined by two variables of engine operation. A two-dimensional table having addresses dependent on one of the two variables is provided. Data stored in the two-dimensional table is updated with a new data obtained at the determined steady state at a corresponding address.

10 Claims, 6 Drawing Sheets

START
101
MAX>N>MIN
N
Y
102
DETECT POSITION IN MATRIX
103
MAX>L>MIN
N
Y
104
DETECT POSITION IN MATRIX
105
COMPARE POSITION WITH LAST POSITION
Y
N
106
OUTPUT OF O2 - SENSOR CHANGES
Y
N
107
SUBSTITUTE WITH NEW POSITION
108
COUNT
109
COUNT=3
N
Y
111
CLEAR COUNTER
CLEAR COUNTER
110
112
122
EXIT

LEARNING CONTROL SYSTEM FOR CONTROLLING AN AUTOMOTIVE ENGINE

BACKGROUND OF THE INVENTION

The present invention relates to a system for controlling the operation of an automotive engine, and more particularly to a learning control system for updating data stored in a table for the learning control. In the learning control system, the updating of data is performed with new data obtained during the steady state of engine operation. Accordingly, means for determining whether the engine operation is in steady state is necessary. A conventional learning control system has a matrix (two-dimensional lattice) comprising a plurality of divisions, each representing engine operating variables such as engine speed and engine load. When the variables continue for a predetermined period of time in one of the divisions, it is determined that the engine is in steady state. On the other hand, a three-dimensional look-up table is provided, in which a matrix coincides with the matrix for determining steady state. For such a three-dimensional table, a RAM having a large capacity must be provided.

SUMMARY OF THE INVENTION

Accordingly, the object of the present invention is to provide a system which may control engine operation with data stored in a RAM having a small capacity.

According to the present invention there is provided a system for controlling an automotive engine by updated data, comprising first means for determining that engine operation is in steady state in accordance with two variables of engine operation and for producing an output signal, and second means for providing a new data for updating in accordance with engine operating conditions. A two-dimensional table having addresses dependent on one of the two variables is provided for storing data necessary for the learning control of the engine. The data stored in the two-dimensional table is updated with the new data in response to the output signal of the first means at a corresponding address.

In an aspect of the present invention, the system further comprises fourth means for detecting one engine operating condition and for producing a feedback signal dependent on the condition, and the new data for updating is dependent on the feedback signal.

The other objects and features of this invention will become understood from the following description with reference to the accompanying drawings.

DETAILED DESCRIPTION OF THE PREFERRED EMBODIMENT

Figure 1:
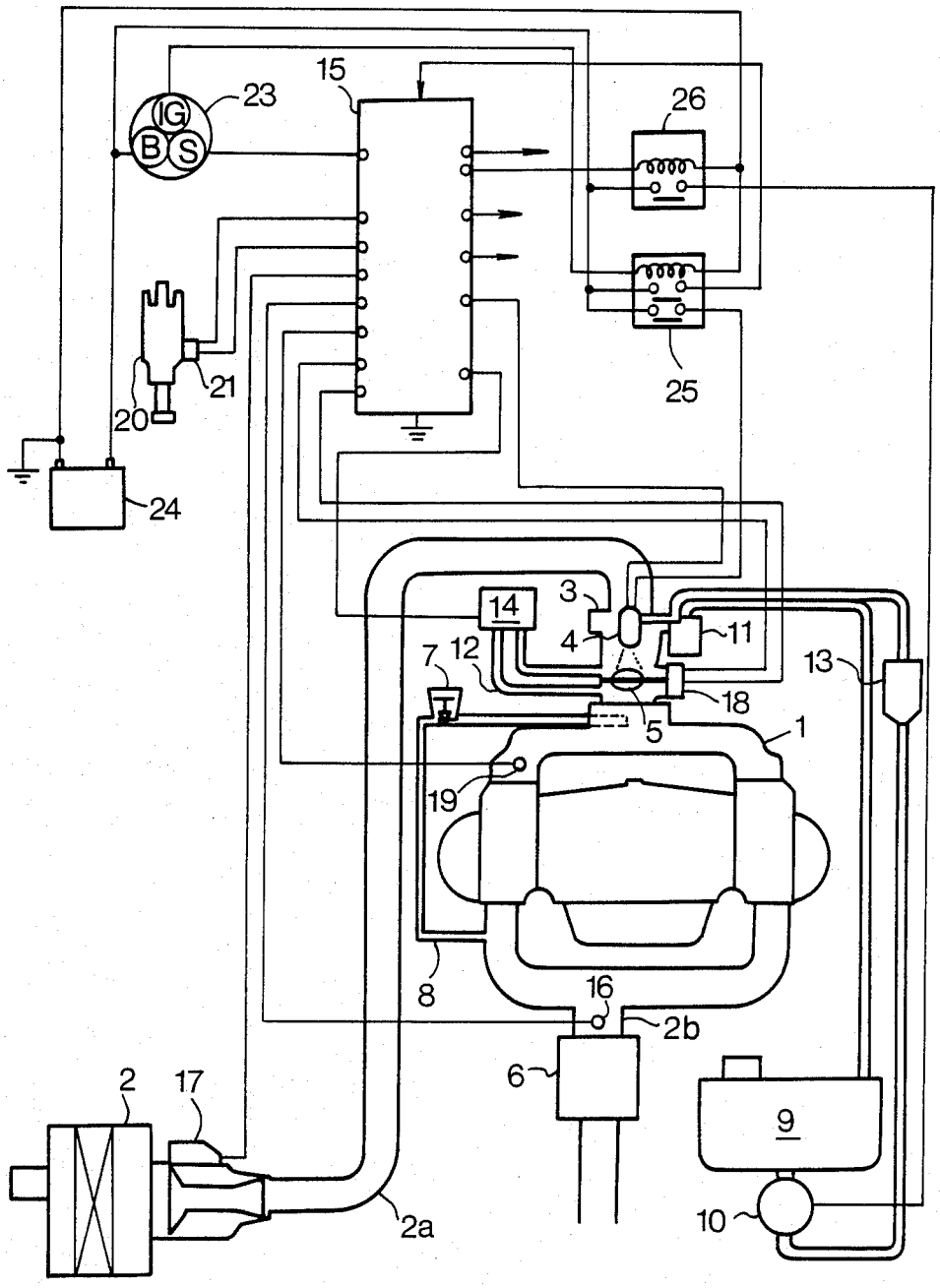
FIG. 1 is a schematic illustration showing a system for controlling the operation of an internal combustion engine for a motor vehicle.

Referring to FIG. 1, an internal combustion engine 1 for a motor vehicle is supplied with air through an air cleaner 2, intake pipe 2*a*, and throttle valve 5 in a throttle body 3, mixing with fuel injected from an injector 4. A three-way catalytic converter 6 and an $O_2$-sensor 16 are provided in an exhaust passage 2*b*. An exhaust gas recirculation (EGR) valve 7 is provided in an EGR passage 8 in a well known manner.

Fuel in a fuel tank 9 is supplied to the injector 4 by a fuel pump 10 through a filter 13 and pressure regulator 11. A solenoid operated valve 14 is provided in a bypass 12 around the throttle valve 5 so as to control engine speed at idling operation. A mass air flow meter 17 is provided on the intake pipe 2*a* and a throttle position sensor 18 is provided on the throttle body 3. A coolant temperature sensor 19 is mounted on the engine. Output signals of the meter 17 and sensors 18 and 19 are applied to a microcomputer 15. The microcomputer 15 is also applied with a crankangle signal from a crankangle sensor 21 mounted on a distributor 20 and a starter signal from a starter switch 23 which operates to turn on-off electric current from a battery 24. The system is further provided with an injector relay 25 and a fuel pump relay 26 for operating the injector 4 and fuel pump 10.

Figure 2:
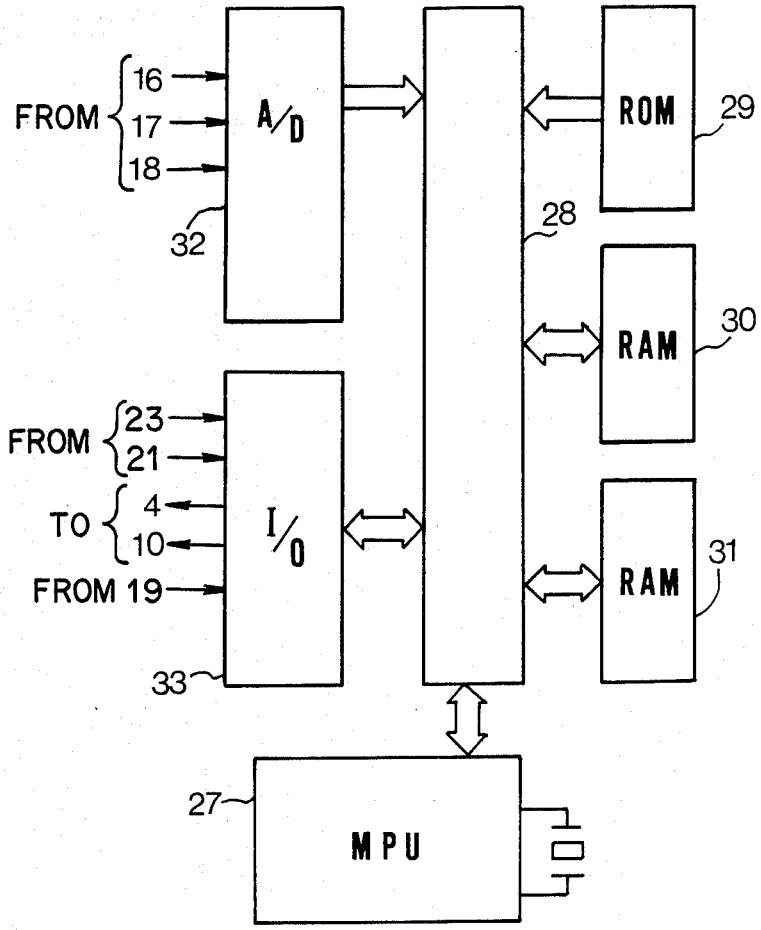
FIG. 2 is a block diagram of a microcomputer system used in a system of the present invention.

Referring to FIG. 2, the microcomputer 15 comprises a microprocessor unit 27, ROM 29, RAM 30, RAM 31 with back-up, A/D converter 32 and I/O interface 33. Output signals of the $O_2$-sensor 16, mass air flow meter 17 and throttle position sensor 18 are converted to digital signals and applied to the microprocessor unit 27 through a bus 28. Other signals are applied to the microprocessor unit 27 through I/O interface 33. The microprocessor manipulates the input signals and executes the hereinafter described process.

In the system, the amount of fuel to be injected by the injector 4 is determined in accordance with engine operating variables such as mass air flow, engine speed and engine load. The amount of fuel is determined by a fuel injector energization time (injection pulse width). Basic injection pulse width ($T_p$) can be obtained by the following formula.

$$T_p = K \times Q/N \quad (1) \qquad (1)$$

where Q is mass air flow, N is engine speed, and K is a constant.

Desired injection pulse width ($T_i$) is obtained by correcting the basic injection pulse ($T_p$) with engine operating variables. The following is an example of a formula for computing the desired injection pulse width.

$$T_i = T_p \times (COEF)\alpha \times K_a \qquad (2)$$

where COEF is a coefficient obtained by adding various correction or compensation coefficients such as coefficients on coolant temperature, full throttle open, engine load, etc., $\alpha$ is a $\lambda$ correcting coefficient (the integral of the feedback signal of the $O_2$-sensor 16), and $K_a$ is a correcting coefficient by learning (hereinafter called learning control coefficient). Coefficients, such as coolant temperature coefficient and engine load, are obtained from look-up tables in accordance with sensed informations.

Figure 3A:
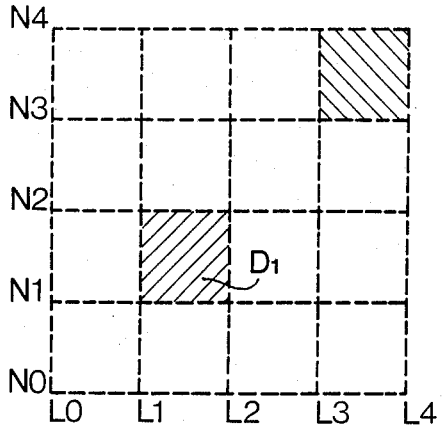
FIG. 3*a* is an illustration showing a matrix for detecting the steady state of engine operation.

The learning control coefficients $K_a$ stored in a $K_a$-table are updated with data calculated during the steady state of engine operation. In the system, the steady state is determined by range of engine load and engine speed and continuation of a detected state. FIG. 3a shows a matrix for the detection, which comprises, for example sixteen divisions defined by five row lines and five column lines. Magnitudes of engine load are set at five points $L_0$ to $L_4$ on the X axis, and magnitudes of engine speed are set at five points $N_0$ to $N_4$ on the Y axis. Thus, the engine load is divided into four ranges, that is $L_0$–$L_1$, $L_1$–$L_2$, $L_2$–$L_3$, and $L_3$–$L_4$. Similarly, the engine speed is divided into four ranges.

Figure 4A:
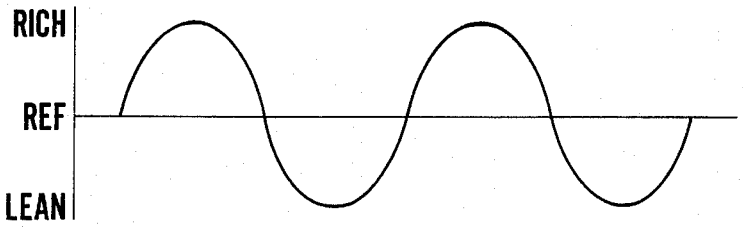
FIG. 4*a* shows the output voltage of an $O_2$-sensor.

On the other hand, the output voltage of the $O_2$-sensor 16 cyclically changes through a reference voltage corresponding to a stoichiometric air-fuel ratio, as shown in FIG. 4a. Namely, the voltage changes between high and low voltages corresponding to rich and lean air-fuel mixtures. In the system , when the output voltage (feedback signal) of the $O_2$-sensor continues during three cycles within one of the sixteen divisions in the matrix, the engine is assumed to be in steady state.

Figure 3B:
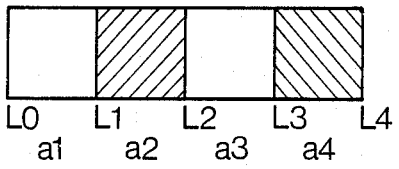
FIG. 3*b* shows a table for learning control coefficients.

FIG. 3b shows a $K_a$-table for storing the learning control coefficients $K_a$, which is included in the RAM 31 of FIG. 2. The $K_a$-table is a two-dimensional table and has addresses $a_1$, $a_2$, $a_3$, and $a_4$ which corresponding to engine load ranges $L_0$–$L_1$, $L_1$–$L_2$, $L_2$–$L_3$, and $L_3$–$L_4$. All of the coefficients $K_a$ stored in the $K_a$-table are initially set to the same value, that is the number "1". This is caused by the fact that the fuel supply system is to be designed to provide the most proper amount of fuel without the coefficient $K_a$. However, every automobile can not be manufactured to have a desired function, resulting in the same results. Accordingly, the coefficient $K_a$ should be updated by learning at every automobile, when it is actually used.

Figure 4B:
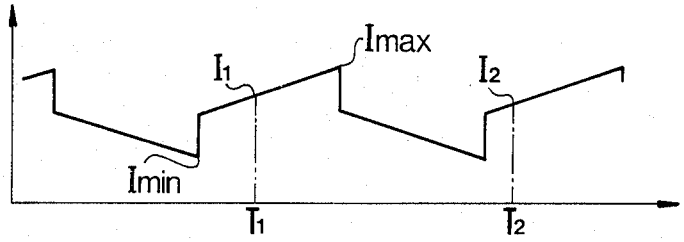
FIG. 4*b* shows the output voltage of an integrator.

Explaining the calculation of the injection pulse width ($T_i$ in formula 2) at starting of the engine, since the temperature of the body of the $O_2$-sensor 16 is low, the output voltage of the $O_2$-sensor is very low. In such a state, the system is adapted to provide "1" as value of correcting coefficient $\alpha$. Thus, the computer calculates the injection pulse width ($T_i$) from mass air flow (Q), engine speed (N), (COEF), $\alpha$ and $K_a$. When the engine is warmed up and the $O_2$-sensor becomes activated, an integral of the output voltage of the $O_2$-sensor at a predetermined time is provided as the value of $\alpha$. More particularly, the computer has a function of an integrator, so that the output voltage of the $O_2$-sensor is integrated. FIG. 4b shows the output of the integrator. The system provides values of the integration at a predetermined interval (40 ms) For example, in FIG. 4b, integrals $I_1$, $I_2$—at times $T_1$, $T_2$—are provided. Accordingly, the amount of fuel is controlled in accordance with the feedback signal from the $O_2$-sensor, which signal is represented by its integral.

Explaining the learning operation, when steady state of engine operation is detected, the $K_a$-table is updated with a value relative to the feedback signal from the $O_2$-sensor. The first updating is done with an arithmetical average (A) of maximum value and minimum value in one cycle of the integration, for example values of Imax and Imin of FIG. 4b. Thereafter, when the value of $\alpha$ is not 1, the $K_a$-table is incremented or decremented with a minimum value ($\Delta A$) which can be obtained in the computer. Namely one bit is added to or subtracted from a BCD code representing the value A of the coefficient $K_a$ which has been rewritten at the first learning.

Figure 7A:
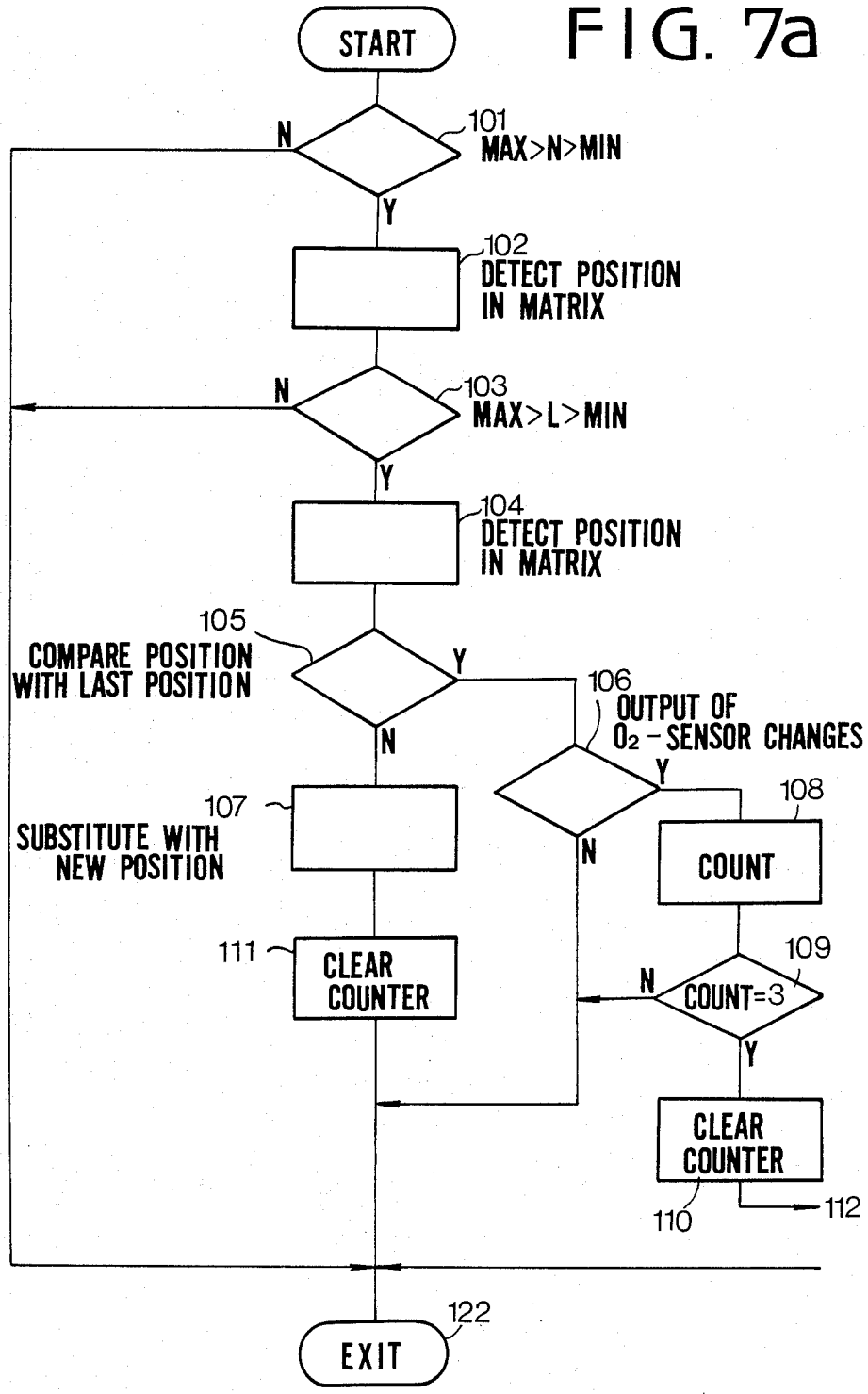
FIG. 7*a* and 7*b* are flowcharts showing the operation in an embodiment of the present invention.
Figure 7B:
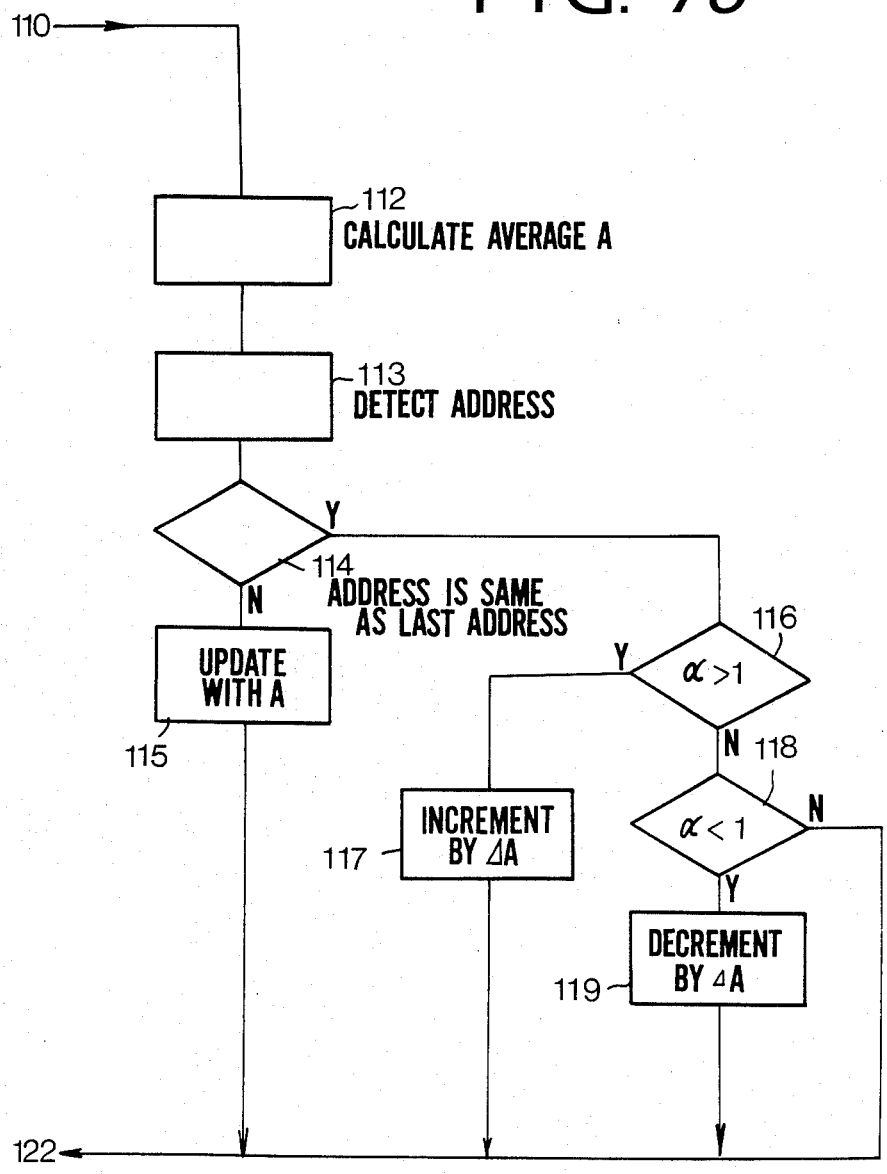

The operation of the system will be described in more detail with reference to FIG. 7. The learning program is started at a predetermined interval (40 ms). At the first operation of the engine and the first driving of the motor vehicle, engine speed is detected at step 101. If the engine speed is within the range between $N_0$ and $N_4$, the program proceeds to a step 102. If the engine speed is out of the range, the program exits the routine at a step 122. At step 102, the position of the row of the matrix of FIG. 3a in which the detected engine speed is included is detected and the position is stored in RAM 30. Thereafter, the program proceeds to a step 103, where engine load is detected. If the engine load is within the range between $L_0$ and $L_4$, the program proceeds to a step 104. If the engine load is out of the range, the program exits the routine. Thereafter, the position of the column corresponding to the detected engine load is detected in the matrix, and the position is stored in the RAM. Thus, the position of the division corresponding to the engine operating condition represented by engine speed and engine load is decided in the matrix, for example, division $D_1$ is detected in FIG. 3a. The program advances to a step 105, where the detected position of the division is compared with the division which has been detected at the last learning However, since the learning is the first, the comparison can not be performed, and hence the program is terminated passing through steps 107 and 111. At the step 107, the position of the division is stored in RAM 30.

At a learning after the first learning, the detected position is compared with the last stored position of the division at step 105. If the position of the division in the matrix is the same as the last learning, the program proceeds to a step 106, where the output voltage of $O_2$-sensor 16 is detected If the voltage changes from rich to lean and vice versa, the program goes to a step 108, and if not, the program is terminated. At the step 108, the number of the cycle of the output voltage is counted by a counter. If the counter counts up to, for example three, the program proceeds to a step 110 from a step 109. If the count does not reach three, the program is terminated. At the step 110, the counter is cleared and the program proceeds to a step 112.

On the other hand, if the position of the division is not the same as the last learning, the program proceeds to step 107, where the old data of the position is substituted with the new data. At the step 111, the counter which has operated at step 108 in the last learning is cleared.

At step 112, the arithmetical average A of maximum and minimum values of the integral of the output voltage of the $O_2$-sensor at the third cycle of the output waveform is calculated and the value A is stored in a RAM. Thereafter, the program proceeds to a step 113, where the address corresponding to the position of the division is detected, for example, the address $a_2$ corresponding to the division $D_1$ is detected and the address is stored in a RAM to set a flag. At step 114, the stored address is compared with the last stored address. Since, before the instant learning, no address was stored, the program proceeds to a step 115. At a step 115, the learning control coefficient $K_a$ in the address of the $K_a$-table of FIG. 3b is entirely updated with the new value A, that is the arithmetical average obtained at step 112.

At a learning after the first updating, if the address detected at the process is the same as the last address, (the flag exists in the address) the program proceeds from step 114 to a step 116, where it is determined whether the value of $\alpha$(the integral of the output of the $O_2$-sensor) at the learning is greater than "1". If the $\alpha$ is greater than "1", the program proceeds to a step 117, where the minimum unit $\Delta A$ (one bit) is added to the learning control coefficient $K_a$ in the corresponding address. If $\alpha$ is less than "1", the program proceeds to a step 118, where it is determined whether the $\alpha$ is less than "1". If $\alpha$ is less than "1", the minimum unit $\Delta A$ is subtracted from $K_a$ at a step 119. If $\alpha$ is not less than "1", which means that $\alpha$ is "1", the program exits the updating routine. Thus, the updating operation continues until the value of the becomes "1".

Figure 5:
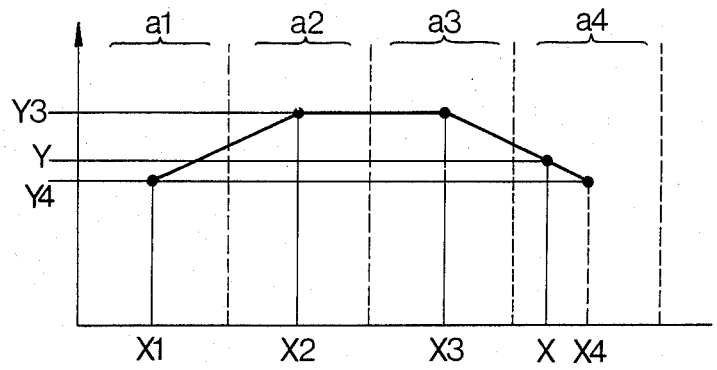
FIG. 5 shows a linear interpolation for reading the table of FIG. 3*b;*

When the injection pulse width ($T_i$) is calculated, the learning control coefficient $K_a$ is read out from the $K_a$-table in accordance with the value of engine load L. However, values of $K_a$ are stored at intervals of loads. FIG. 5 shows an interpolation of the $K_a$-table. At engine loads $X_1$, $X_2$, $X_3$, and $X_4$, updated values $Y_3$ and $Y_4$ (as coefficient K) are stored. When the detected engine load does not coincide with the set loads $X_1$ to $X_4$, coefficient $K_a$ is obtained by linear interpolation. For example, value Y of $K_a$ at engine load X is obtained by the following formula.

$$Y=((X-X_3)/(X_4-X_3))\times(Y_4-Y_3)+Y_3$$

Figure 6A:
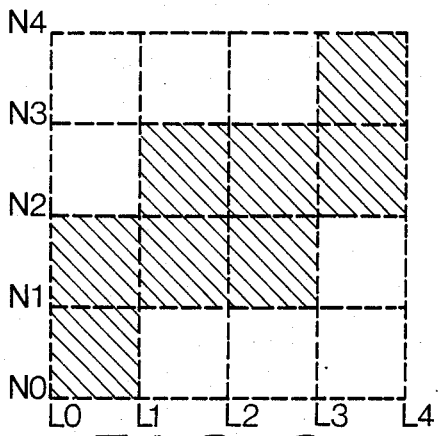
FIGS. 6*a* and 6*b* are illustration for explaining probability of updating.
Figure 6B:
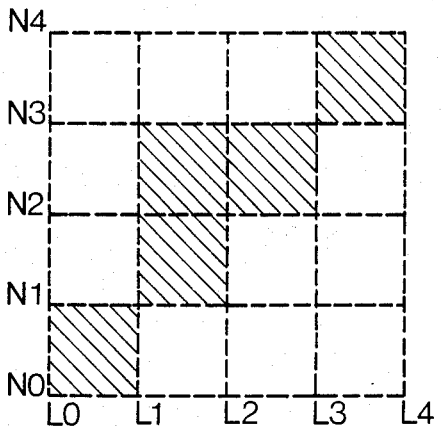

FIG. 6*a* is a matrix pattern showing the updating probability over 50% and FIG. 6*b* is a pattern showing the probability over 70% by hatching divisions in the matrix. More particularly, in the hatched range in FIG. 6*b*, the updating occurs at a probability over 70%. From the figures, it will be seen that the updating probability at extreme engine operating steady states, such as the state at low engine load at high engine speed and at high engine load at low engine speed, is very small. In addition, it is experienced that the difference between the values of the coefficient $K_a$ in adjacent speed ranges is small. Accordingly, it will be understood that the two-dimensional table, in which a single datum is stored at each address, is sufficient for performing the learning control of an engine.

Thus, in accordance with the present invention, the system controls engine operation with data stored in a memory having a small capacity, whereby the system can be simplified in construction and reduced in size.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A system for controlling an automotive engine by updated data, comprising:

control means for determining that engine operation is in steady state for a predetermined period with respect to two variables of engine operation and for producing an output signal when the steady state is so determined;

said control means including a memory which stores data in the form of a two-dimensional look-up table having addresses corresponding to ranges of one of the two variables, storing the data in accordance with engine operating conditions at the addresses;

said control means further for updating the data stored in the two-dimensional look-up table with new data in accordance with prevailing of said engine operating conditions in response to the output signal at an address of the table corresponding to the range of said one of said two variables occurring during the prevailing steady state; and means for controlling the engine dependent on prevailing of the data present in the look-up table.

2. The system according to claim 1, including means for detecting an engine operating condition and for producing a feedback signal dependent on the detected condition, the new data for updating being dependent on the feedback signal.

3. The system according to claim 2, wherein said control means provides said new data as average value of maximum and minimum values of the integral of said feedback signal at a first updating of the corresponding address and thereafter by incrementing and respectively decrementing the data stored in the corresponding address of the table if the integral of the feedback signal is greater and respectively less than a desired value.

4. The system according to claim 2, wherein said detected engine operating condition is oxygen content of exhaust gases of the engine.

5. The system according to claim 1, wherein said control means is further for continuing its operation of updating until the engine reaches a desired condition.

6. The system according to claim 1, wherein said control means is a computer.

7. The system according to claim 1, wherein said control means is a microprocessor.

8. A method for updating data in an apparatus for controlling air-fuel ratio in an automotive engine by the updated data, comprising the steps of:

detecting engine operating conditions;

determining that engine operation is in steady state by determining whether two variables of engine operation stay in one division of a matrix for a predetermined period, the matrix being formed of divisions of ranges of the two variables of engine operation, and producing an output signal when the steady state is so determined;

storing learning control coefficients in a two-dimensional look-up table having a plurality of divisions corresponding to that of one of said two variables;

providing new data for updating the learning control coefficients in accordance with engine operating conditions; and in response to the output signal, updating a coefficient stored in the two-dimensional look-up table with the new data at one of the divisions of the loop-up table corresponding to said one division of said matrix in which latter division said one variable stays during said predetermined period of determining said steady state.

9. The method according to claim 8, further comprising the step of producing a feedback signal dependent on one of the detected engine operating conditions, the new data for updating being dependent on the feedback signal.

10. A method for controlling air-fuel ration of an air-fuel mixture in an automotive engine, comprising the steps of detecting engine operating conditions, determining that engine operation is in a steady state by determining whether two variables of engine operation stay in any one of divisions of a matrix for a predetermined period, the matrix being defined by ranges of the two variables of engine operation, producing a steady state signal when the steady state is determined, storing learning control coefficients in respective divisions of a two-dimensional look-up table having a plurality of divisions arranged in an array, each of the latter divisions having an address corresponding to the ranges of one of said two variables of the matrix, detecting oxygen concentration of exhaust gases of the engine and producing an output voltage dependent on the oxygen concentration, providing new data to be used for updating the respective coefficients in accordance with engine operating conditions, updating a coefficient stored in the two-dimensional look-up table with the new data in response to the steady state signal at an address in the two-dimensional look-up table corresponding to the range of said one of said two variables of the matrix occurring in the prevailing steady state.

* * * * *